US006616014B1

(12) United States Patent
Pozniak et al.

(10) Patent No.: US 6,616,014 B1
(45) Date of Patent: Sep. 9, 2003

(54) PRECISION LIQUID MIXING APPARATUS AND METHOD

(75) Inventors: Peter Martin Pozniak, San Jose, CA (US); Charles Andre Provost, Salinas, CA (US); Rakesh Kumar Singh, Allahabad (IN); Sau Van Vo, San Jose, CA (US); Benjamin Rush Roberts, Los Altos, CA (US)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 09/512,752

(22) Filed: Feb. 25, 2000

(51) Int. Cl.[7] ..... B01F 15/02
(52) U.S. Cl. ..... 222/129.3
(58) Field of Search ..... 156/345; 222/1, 222/16, 18, 19, 20, 55, 59, 61, 71, 129, 129.3, 145.5, 190, 191, 192, 506

(56) References Cited

U.S. PATENT DOCUMENTS 3,979,239 A 9/1976 Walsh
4,021,278 A 5/1977 Hood et al.
4,025,311 A * 5/1977 Bochinski ..... 422/67
4,601,409 A * 7/1986 DiRegolo ..... 222/1
4,823,987 A * 4/1989 Switall ..... 222/63
5,078,302 A * 1/1992 Hellenberg ..... 222/144
5,370,274 A * 12/1994 Ohmi et al. ..... 222/135
5,407,526 A 4/1995 Danielson et al.
5,478,435 A 12/1995 Murphy et al.
5,887,974 A 3/1999 Pozniak et al.
5,922,620 A 7/1999 Shimomura et al.
5,957,759 A * 9/1999 Cardenas et al. ..... 451/60
6,019,250 A 2/2000 Pozniak et al.
6,027,240 A * 2/2000 Han ..... 366/101
6,050,283 A * 4/2000 Hoffman et al. ..... 137/3
6,098,843 A * 8/2000 Soberanis et al. ..... 222/53
6,168,048 B1 * 1/2001 Xu et al. ..... 222/1

* cited by examiner

*Primary Examiner*—Gregory Mills
*Assistant Examiner*—Sylvia R. MacArthur
(74) *Attorney, Agent, or Firm*—Finnegan, Henderson, Farabow, Garrett & Dunner LLP

(57) ABSTRACT

A system, apparatus and method is disclosed for providing a consistent liquid mixture according to a predetermined recipe for use at a point of use. The apparatus includes a plurality of liquid component reservoirs in which a constant gas pressure is maintained. A plurality of valves are provided, with individual valves connected to an outlet port of each reservoir. An electronic controller controls the valve actuation in a repetitive sequence to discharge predetermined doses of selected liquid components for mixing to form the consistent liquid mixture. A mixing section receives the sequence of doses to mix them together to form the liquid mixture.

51 Claims, 7 Drawing Sheets

PRECISION LIQUID MIXING APPARATUS AND METHOD

DESCRIPTION OF THE INVENTION

1. Field of the Invention

The present invention relates to an apparatus and method for precisely consistently producing liquid mixtures according to a predetermined recipe, and a particular embodiment for producing slurry mixtures at the point of use for chemical mechanical polishing or planarization (CMP) processing of semiconductor wafers.

2. Background of the Invention

Much of current production CMP processing relies on mixing rather large volumes of expensive slurry in a batch preparation process somewhat remote from the point of use at a CMP workstation. The CMP processing requires many polisher workstations and hence many wafers being processed with a consistent slurry for uniform wafer results. Some slurries, particularly those including oxidizers, degrade over time. Slurry degradation results from chemical reactions that start immediately upon blending of the chemical components of the slurry. In order to maintain consistent slurries, expensive metrological instrumentation and spiking systems monitor and automatically correct mix concentrations. Often these bulk or batch slurry mixtures drift so far out of specification that restoration becomes impossible, resulting in expensive slurry waste.

More recent development has been directed to developing point of use slurry blending, or on demand blending. In U.S. Pat. No. 6,019,250, owned by the assignee of the present invention, an apparatus and method is shown for dispensing a liquid at one or more points of use from a plurality of reservoirs with a constant flow rate of liquid. This apparatus and method include a programmable logic controller for controlling valves for filling and dispensing the various liquid components to and from the reservoirs, and for controlling provision of a constant gas pressure in the reservoirs to effect the constant flow rate for the liquids. The disclosure of this patent is incorporated by reference into this application.

In another U.S. Pat. No. 5,887,974, also owned by the assignee of the present invention, a slurry mixing apparatus is disclosed using a static mixer and/or a hopper mixer in which several streams of slurry concentrate and additive chemical components are pumped together as a single stream which is blended or mixed to produce a homogeneous slurry. The disclosure of this patent is incorporated by reference into this application as well.

Other point of use slurry mixing and delivery systems are disclosed in U.S. Pat. Nos. 5,478,435 and 5,407,526. In the system of U.S. Pat. No. 5,407,526, slurry pumps preferably use a single motor to ensure the individual slurry component pumps are operated in phase for better control of the mixing of the slurry. In U.S. Pat. No. 5,478,435, the mixing of the slurry and diluting agent occurs at the point of use on the pad used in the CMP process. Liquid monitoring and control systems are used to maintain a consistent temperature and flow rate for the slurry components.

Even with such prior art on-demand or point of use slurry blending there is a desire for improved slurry consistency and greater flexibility in changing the slurry recipe during CMP wafer processing. The term slurry has a well known meaning of a mixture of liquid and finely divided particles.

There exists a general need in industry to be able to produce consistent liquid mixtures from a plurality of selected liquid components according to a predetermined recipe. It is desired that the recipe be able to be varied for flexibility of operations as well as to adjust the amounts of each liquid component not only as the desired recipe is changed, but as the characteristics of the liquid components change over time.

SUMMARY OF THE INVENTION

In accordance with the invention, a method, apparatus and system are provided for producing consistent liquid mixture according to a predetermined recipe. The apparatus comprises a plurality of liquid component reservoirs including an inlet port for loading a selected liquid component into a respective reservoir, and an outlet port through which the liquid component can be discharged. A gas manifold is provided for providing the same gas pressure within each reservoir. A plurality of valves are individually coupled to the respective outlet ports of the reservoirs. An electronic controller controls repetitive, sequences actuation of the valves to discharge precise amounts or volumes of the liquid components from the reservoirs to provide the desired liquid components as doses which are mixed together to form the liquid mixture according to the predetermined recipe.

The apparatus and method of the present invention effectuate the production of the precise, consistent liquid mixtures from the embedded electronic controller either by varying the number of actuation cycles for the valves which all have, the same actuation period, or by repetitively sequenced actuation of the valves while varying the actuation period of the valves, i.e., for normally closed valves varying the valve open periods.

In a preferred embodiment of the invention, a method, apparatus, and system are providing for producing consistent slurry mixtures to a point of use, such as a CMP polisher for semiconductor wafers. The apparatus comprises a plurality of slurry component reservoirs which include an inlet port for loading a selected slurry component into the respective reservoir, and an outlet port. Gas supply means are included to provide the same gas pressure within each reservoir. A plurality of valves, preferably having relatively high activation rates, are individually coupled to the respective outlet ports of the reservoirs. An electronic controller controls repetitive sequenced actuation of the plurality of valves to discharge upon each valve actuation precise doses of the selected components from the reservoirs to provide the desired components which are then mixed to form the predetermined consistent slurry.

The present invention also includes a system in which the apparatus of the present invention is in communication with a central operational controller which determines the selected slurry recipe which is to be blended in the apparatus for use at the point of use. The system also includes a slurry component supplier including sources of slurry components and valves via which the components fill the plurality of component reservoirs.

In a preferred embodiment, the present invention takes on-demand liquid mixing to a higher level with greater precision of resultant liquid mixture consistency and with flexibility in dynamically mixing recipes for specific CMP processing requirements. This system preferably permits varying the liquid mixture during wafer polishing and provides for rapid turn around for processing additional wafers to differing requirements.

The present invention preferably takes a different approach; mixing liquids such as slurries immediately prior to use, in the precise quantities required (for example, in the CMP embodiment, 100 to 200 ml per wafer) and allowing dynamic control of the mix recipe during wafer polishing. By utilizing relatively high frequency, rapid opening and closing valves producing many small sequential "shots" or doses from each of several component reservoirs, one can achieve a precise, repeatable slurry mixing with a statistical averaging algorithm applying to numerous very small shots as well as it applies to very large batches in achieving the desired slurry mixture.

At least three different valving techniques provide the desired valve actuation cycles to achieve the statistical averaging algorithm particularly in small mixture volume applications: 1. Solenoid driven valves, 2. Stepper motor driven rotary valves and 3. Pezio electric effect driven valves may be used to provide the repetitive small dose addition of slurry components from the reservoirs to achieve the desired slurry mixture.

Pressurized component reservoirs preferably hold enough of each component to process one wafer. A recharge module quickly refills these reservoirs just prior to wafer polishing. Flow rate is controlled by maintaining the same reservoir dispense pressures coupled with hydraulic losses through the valves and static mixing elements. Each component valve "opens" and "closes" sequentially the desired number of times in each recipe segment. While, preferably, only one valve is "open" at any time, more than one valve can be actuated at the same time to increase the component doses supplied in a given time period. Overlapping operation of adjacent valves can ensure consistent flow rate of mixed product. The "open" time of each component valve varies depending on the current recipe segment requirements. Each recipe may consist of numerous segments, each segment may have a unique mix formula. Computer control enables dynamic recipe adjustment based on metrology of components (incoming chemicals), process results or product requirements. A flow sensor or scale monitors flow of the mixed product and reports flow rates at the end of each recipe segment to the host controller. The system takes configurable actions upon detection of insufficient or excessive flow rates, as defined with each recipe download. Recipes with variable flow rates are also possible.

In a preferred embodiment the design preferably supports five metered components and unmetered components although the number of components and reservoirs is a matter of choice. The mixing apparatus is integrated for operations with the CMP Polisher. The recharge components should be pressurized externally. Process nitrogen, deionized water and cleaning chemicals provide flush/purge and cleaning facility.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an apparatus, method and system consistent with the invention, and together with the description, serve to explain the advantages and principles of the invention.

DESCRIPTION OF THE PREFERRED EMBODIMENTS

Reference will now be made in detail to an implementation consistent with the present invention as illustrated in the accompanying drawings. Wherever possible, the same reference numbers will be used throughout the drawings and the following description to refer to the same or like parts.

While the invention has application to the precise, consistent mixing of liquid components to produce a liquid mixture according to a predetermined recipe, a preferred embodiment of the invention will be described for slurry mixtures at a point of use.

Figure 1:
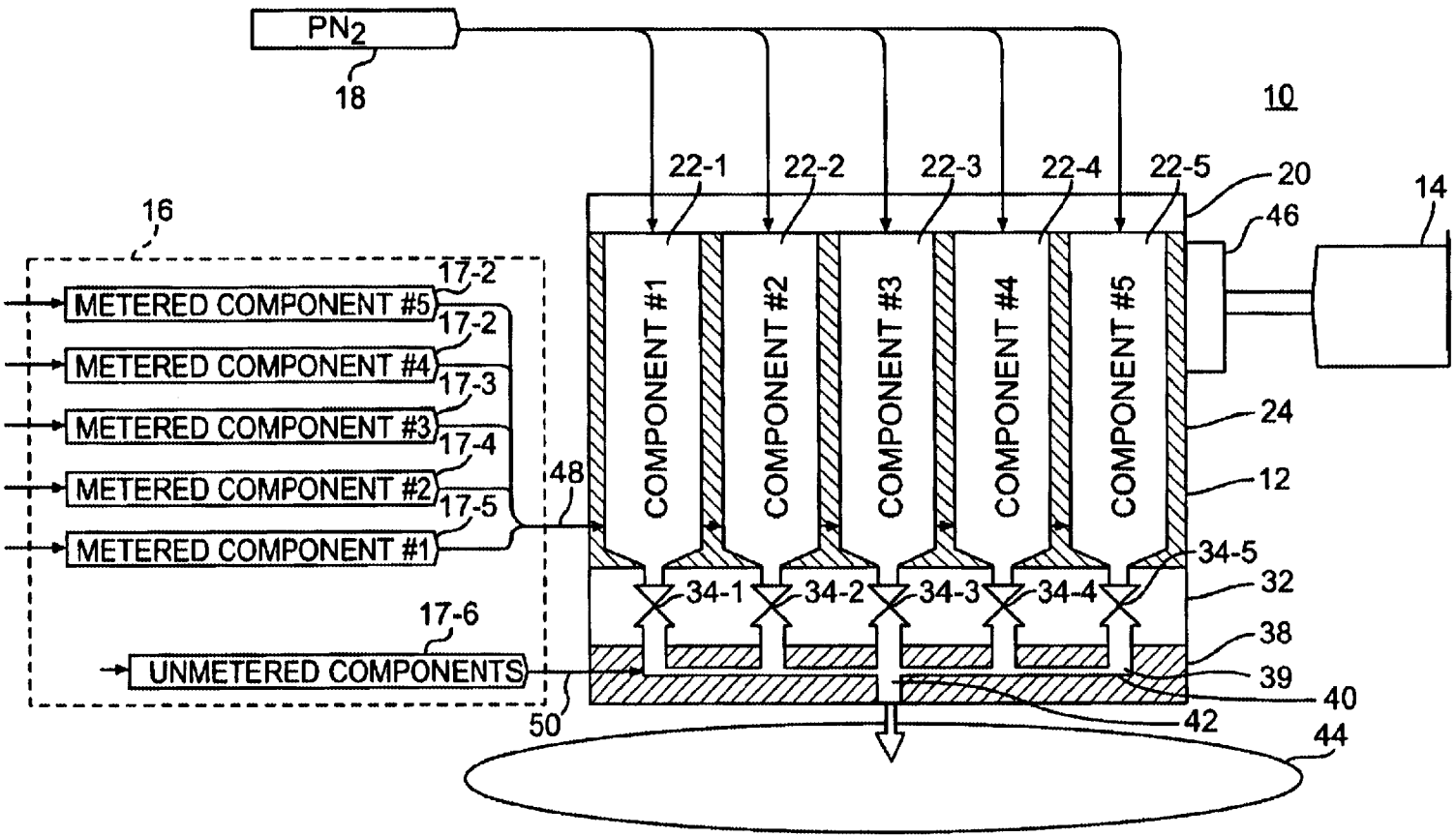
FIG. 1 is a schematic illustration of the apparatus and system of the present invention.

FIG. 1 illustrates schematically the system and apparatus of an embodiment of the present invention with the slurry blending system 10 including the point of use slurry. blending apparatus 12 which is coupled communication-wise to a central remote host control operations center 14 via a communication link as shown, which can be hardwired, or linked by an rf or optical link, not shown. The central control operations center 14 controls a number of point of use slurry blending apparatus 12 and the CMP polishing workstation 13 with which the apparatus is used.

The system 10 includes a slurry component supplier 16 and gas pressure supplier 18 both of which are connected to the apparatus 12 as will be described in detail below. The slurry component supplier 16 includes a plurality of slurry component supply members, 17-1 through 17-5 which provides metered components and supply member 17-6 provides unmetered components, with supply control valves, not shown, which control the supply of the necessary slurry recipe components to the point of use apparatus 12.

Figure 2A:
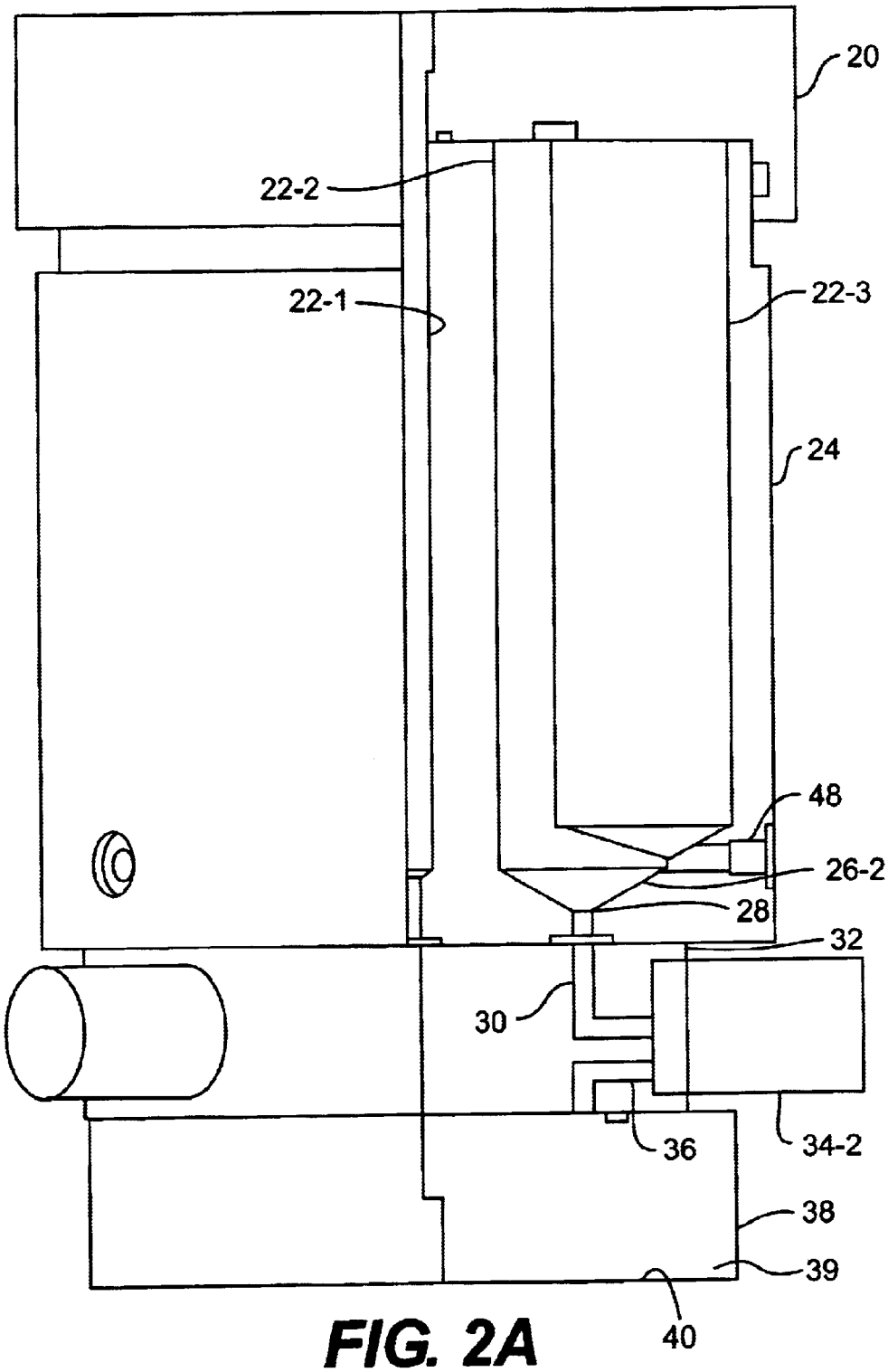
FIG. 2A is a side elevation view of the apparatus of the present invention partly broken away and partly in section to illustrate the reservoir structure and discharge valving.
Figure 2B:
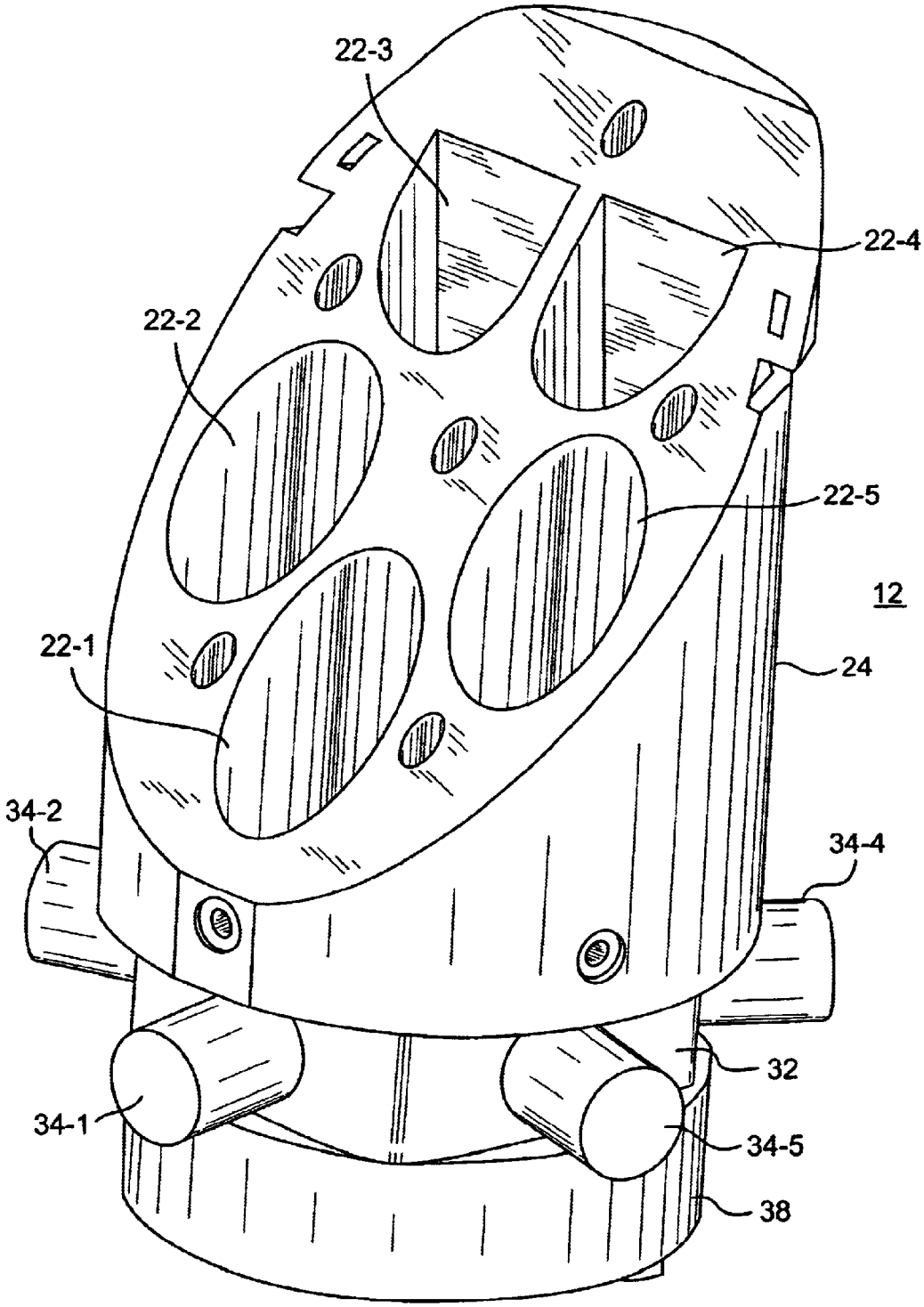
FIG. 2B is a side elevation view of the apparatus of the present invention partly broken away at an angle to the longitudinal axis to illustrate the reservoir structure.

The apparatus 12 is seen schematically in FIG. 1 and in side elevation with a partial sectional view in FIGS. 2A and 2B. The apparatus 12 includes the following sections starting from the top; a gas manifold section 20 which is connected to the gas pressure supplier means 18 to allow a constant pressure of inert gas, such as nitrogen to be maintained in the five generally cylindrical reservoirs 22-1, 22-2, 22-3, 22-4, and 22-5 which comprise the reservoir section 24. These five reservoirs 22-1 through 22-5 are arranged in an annular array spaced about a central longitudinal axis of the generally cylindrical apparatus 12. While five reservoirs are shown in the embodiment of the invention described here, the number of reservoirs can be varied. The five reservoirs allow for the inclusion of enough slurry components to meet most slurry recipe demands. The number of valves preferably should match the number of reservoirs provided. The reservoir volume is chosen to hold enough of the different component to satisfy the slurry requirements for polishing a single wafer. The reservoirs, by way of example, each have a volume of 100 milliliters. The bottom extending end of each reservoir has a generally cone shaped end closure 26 with a central outlet port 28 leading to outlet passage 30 connecting to the high speed valve section 32.

A valve section 32 is disposed below the reservoir,section and includes five high speed solenoid valves, 34-1, 34-2, 34-3, 34-4, 34-5, with one valve coupled to a respective reservoir. The valves are mounted transverse to the longitudinal axis of the generally cylindrical reservoir with which it is connected. The outlet passage 30 is connected to the valve inlet and the valve outlet is connected via valve outlet passage 36 to the mixing and flow measuring section 38. While a variety of well known techniques can be used for mixing the precise component doses which are supplied for mixing the slurry components, in a preferred embodiment a smear mixing chamber 39 is included in the mixing and flow measuring section 38. The mixing and flow measuring section 38 includes a mixing chamber 39 spaced below the valve outlet passages 36 with a central aperture 42 through a generally planar smear mixing substrate 40. Flow measurement sensor means 43 is included in section 38 for measuring the blended slurry flow rate as the slurry is discharged from central aperture 42 onto the CMP workpiece. The smear mixing chamber 39 is defined by annular side walls, the bottom substrate and a top wall. The outlet passages 30 continue into apertures in the top wall. The mixing chamber has, by way of example, a very small height of about 0.020 inch between the bottom substrate and the top wall. In order to promote mixing of the dosed components, a plurality of annular grooves are formed in the top wall of chamber 39 in a preferred embodiment. These annular grooves are concentrically disposed about the central aperture 42. These annular grooves are spaced concentrically with the width of the grooves being about 0.25 inch and the groove depth being about 0.060 inch.

Figure 6:
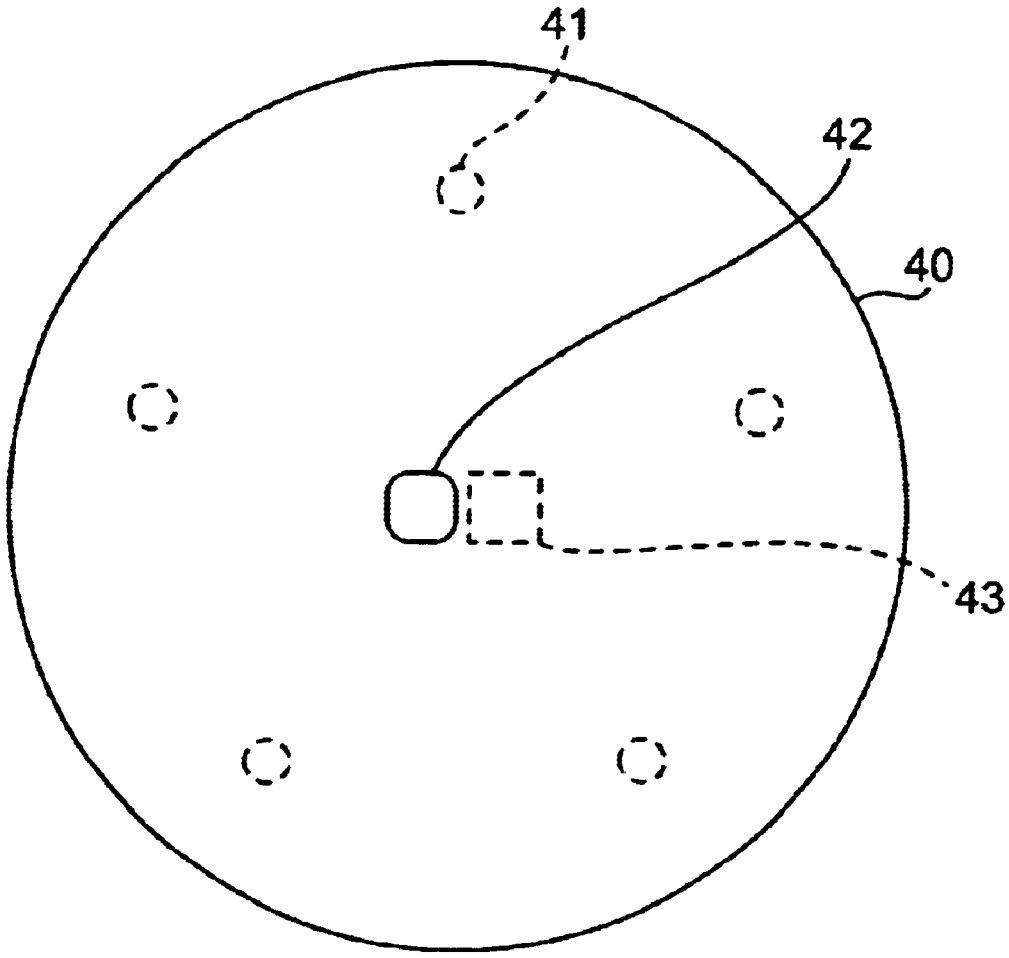
FIG. 6 is a top plan view of a mixing substrate which is included in the mixing and flow measuring section.

The smear mixing substrate 40 is seen in FIG. 6 in a top plan view. The smear mixing substrate 40 is a circular planar substrate which forms the bottom of mixing chamber 39 which has a volume of, for example 1–2 milliliters, in the mixing and flow measuring section 38. A central discharge aperture or orifice 42 is provided through the substrate 40. The five dotted line circular patterns 41 illustrated near the periphery of substrate 40 represent the initial component doses discharged from the five component reservoirs via the valve outlet passage onto the substrate. The liquid component doses rapidly spread out in enlarging circular patterns and are followed by repeated doses from the repetitive sequential openings of the individual valves. The spreading liquid component doses are smeared and mixed together into the desired slurry mixture which is discharged through the central aperture 42 onto the CMP workpiece. A flow sensor 43 is mounted at the exit side of substrate 40 proximate the central discharge aperture as illustrated in dotted line schematic fashion.

Figure 4:
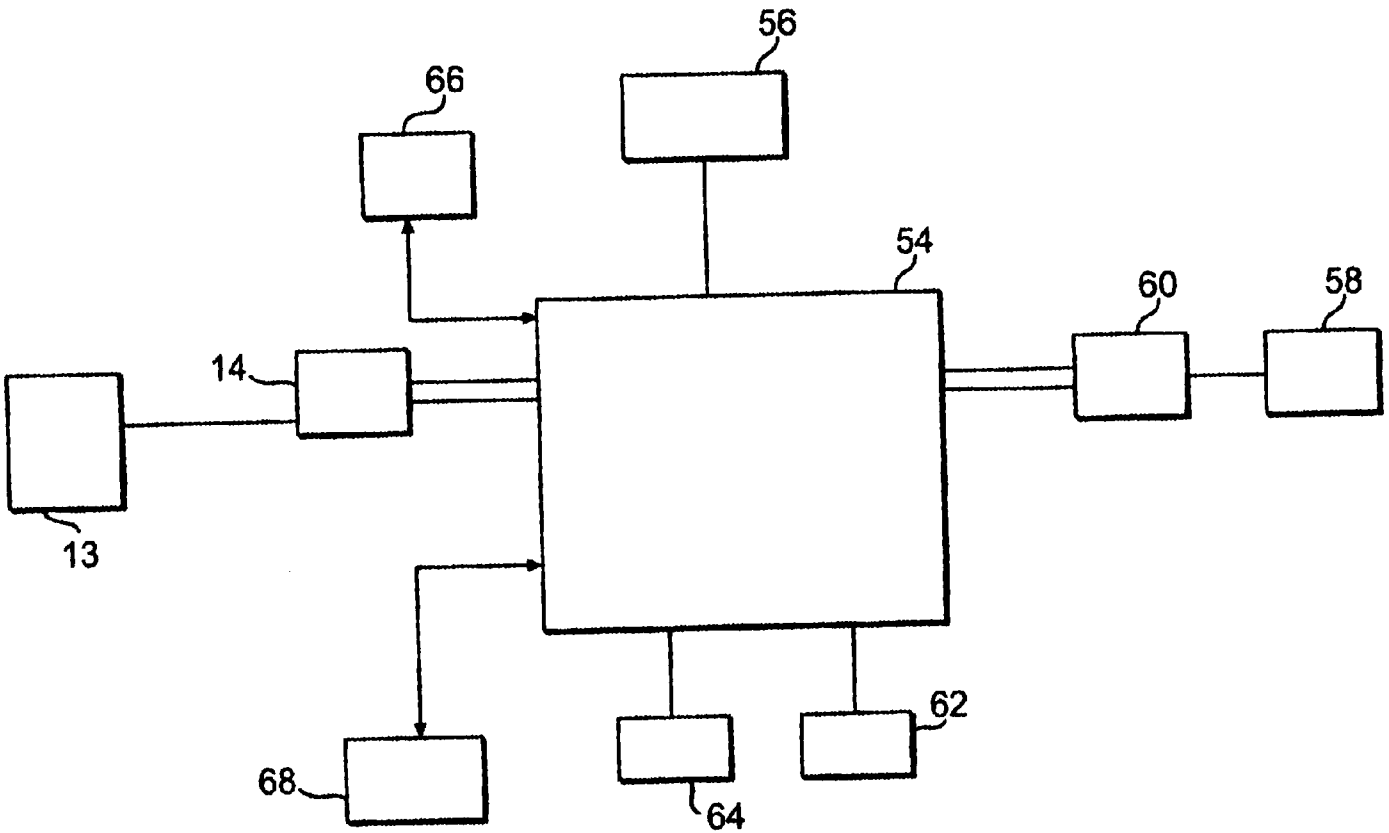
FIG. 4 is an electrical schematic of the electronic control scheme used in the present invention.

An electronic control section 46 is seen mounted on the side of apparatus 12 in the schematic view of FIG. 1, and can be mounted in any convenient location on the apparatus 12 with wiring connection from the microcontroller 48, seen in circuit schematic of FIG. 4, going to the central operation control center 14 for communication of data. The electronic control section 46 will be explained in detail below, including how it is connected to the high speed valves to control the opening of these valves.

A slurry component feed line 48 extends from the slurry component supply 16 to each reservoir to permit filling of the respective reservoir with the selected slurry components, which are typically a slurry concentrate, oxidizer such as hydrogen peroxide, deionized water, and other selected chemical components as are well known and used in CMP processing.

A second feed line 50 also extends into the mixing and flow measuring section 38 to permit an unmetered flow of deionized water or other fluids to flood the mixing chamber for purging and cleaning the system after a slurry blend has been discharged, or for providing deionized water or other chemical agent to the wafer through the mixing chamber central exit aperture.

A preferred difference of the apparatus of the present invention from other point of use slurry blending systems is the highly precise and consistent slurry blends that can be formulated and deposited onto the CMP workpiece. Preferably, the apparatus of the present invention allows for optimization of the slurry recipe for specific CMP requirements. In addition, it preferably permits varying the slurry recipe during wafer polishing. This is accomplished by the very accurate control of the slurry components which are added to form the liquid mixture according to the predetermined recipe as a result of repetitive sequential actuation of the high speed valves to discharge from at least two doses and preferably from about 5 to 20 small doses, of programmable volumes of selected component, per valve opening. These doses are discharged at the periphery of substrate 40, and the doses, rapidly spread in a circular pattern on the substrate 40 and mix with the doses of the other slurry components in a smear mixing which takes place on substrate 40 as the mixture advances to the central discharge aperture 42.

Figure 3:
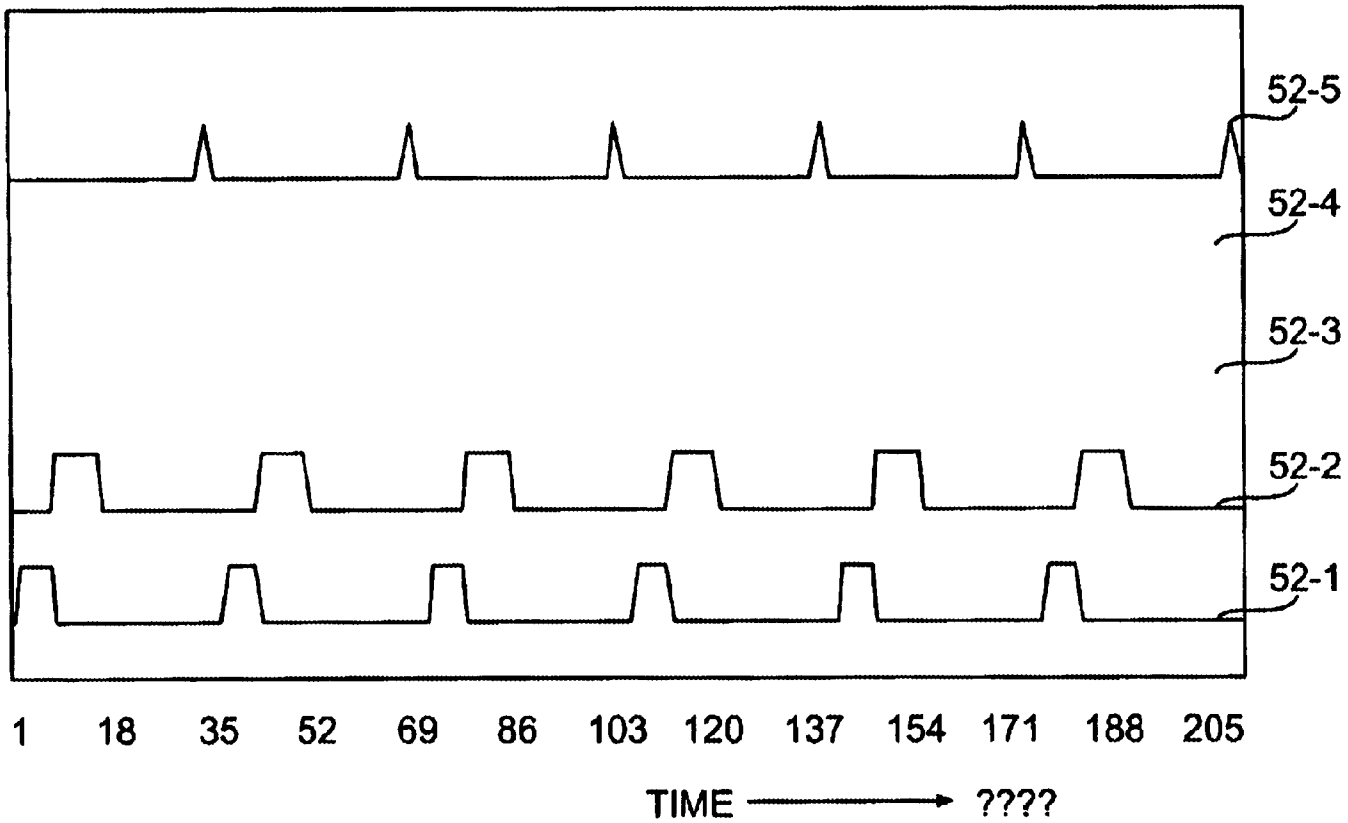
FIG. 3 is a timing chart for the valve opening times for the five component reservoir embodiment and illustrating the repetitive sequencing of the five high speed valves.

The dose volume of a specific selected slurry component is controlled in a preferred embodiment by controlling the valve open time of normally closed valves. This is best seen in FIG. 3, which illustrates the periodic, near square wave, valve open signal which is applied in repetitive sequence to the respective valves for the selected component. There are five plots 52-1 through 52-5 for the valve open signals applied to the respective five valves, and the duration of the valve open signals controls the volume of slurry component which flows under the constant pressure from the reservoir into the mixing and flow measurement section. This valve open signal is plotted against time in milliseconds in FIG. 3. This figure illustrates that the component valves are opened in sequence from component 1 to component 5, and then this valve opening pattern is repeated until the recipe segment is completed. In the example of FIG. 3, there are 6 valve open cycles for each of the component valves which provides a high level of precision and accuracy of the component proportions in the slurry blend based on compensating for the random valve errors. Even greater precision of the component proportions can be had by increasing the number of valve cycles, so that at 20 valve open cycles for every recipe segment the random valve errors are almost entirely eliminated. For small liquid mixture batches with high mixing ratios, the duration of the valve open periods per opening can vary from a few milliseconds to hundreds of milliseconds. As can be seen from the example of FIG. 3, the repeated sequence of six valve openings for each component is shown as completed in a little over 200 milliseconds, although with the embodiment shown the valve open times can be up to 255 milliseconds. For these small liquid mixture batches as described above, in order to ensure thorough mixing and precise accurate component mixtures the actuation of the valves where a selected number of actuation sequences are employed should be such that the valves are actuated open for short durations of from about 1 to 255 milliseconds. The higher valve actuation rate permits use of wider mix ratios of components.

In an alternate embodiment, the predetermined recipe is implemented by a control algorithm where the valves are controlled to have varying actuation open time periods with at least two actuation cycles.

When large batches of liquid components are to be precisely mixed, the valve actuation periods and cycles need not be at such high rates and short time periods as for the small batches described in the preferred embodiment described above.

The microcontroller 54 is the major element in the electronic control section 46, and the electrical circuit schematic shows microcontroller 54 connected to the various elements of the system 10 as seen in FIG. 4. The preferred microcontroller is a product of Microchip Technology, Inc. of Chandler, Ariz., and is product number PIC18C452. The microcontroller 54 performs the following basic functions. The microcontroller performs the communication with the host operation controller 14 to receive and confirm recipe instruction. It is connected to a flow meter in the mixing and flow measuring section to provide feedback on the slurry blend flow rate and completion of delivery of the blended slurry to the workpiece. It performs error detection functions via connection to sensors on the reservoirs which measure the fluid levels in the component reservoirs, and from a variety of sensors which indicate that the slurry component supply means is ready to supply slurry components to the reservoir.

The microcontroller 54 is connected to each of the five high speed valves 34-1 through 34-5 to control the application of the valve open signals to the solenoid which controls opening of the valve, and the microcontroller 54 controls the duration of the valve open signal and the repetitive sequencing of the valves. The high speed valves are preferably solenoid valves. By way of example the high speed valves are solenoid valves sold under the tradename BIO-VALVE and supplied by the FURON division of Saint Goblain Performance Plastics.

The preferred microcontroller 54 is a 40 pin surface mount device with a serial communications port for communicating with the host operation controller. Preferably, microcontroller 54 has in-circuit programming capability with 32K of program memory and 1536 bytes of data memory.

The microcontroller 54 which is a very highspeed device operating at about 40 MHZ is connected to the solenoid valves by individual octal driver latches which permit the very high speed microcontroller to supply operating signals to the solenoids which operate at speeds of up to about 300 hertz, which is a relatively high speed for valve operation.

The microcontroller 54 is seen schematically connected to other system elements in FIG. 4. A source of potential 56 provides power to the microcontroller as well as to the valve solenoids 58 via octal driver latch means 60. While a single means 60 and solenoid 58 are shown in FIG. 4, it should be understood there are five individual means and solenoids since there are five valves and component reservoirs. The microcontroller is shown connected to ground means 62 and a programming means 64 for in-circuit programming. As, mentioned with respect to FIG. 1, the host operation controller 14 is coupled via a serial data link to the microcontroller 54, with host operation controller 14 providing slurry recipe information and general control information to ensure integration of the operation of apparatus 12 with the other equipment, including CMP workstations 13. The microcontroller receives sensor data from sensor means 66, which includes a variety of sensors for measuring slurry flow and for measuring the liquid levels in the reservoirs. Enable and ready means 68 provides input to and receives feedback from the microcontroller regarding the status of ancillary support and safety means.

The microcontroller 54 receives sensor inputs from the slurry flow sensor and from sensors associated with the reservoirs which indicate the relative volume of component in each reservoir. In this way the microcontroller monitors the slurry blending process. Sensors associated with the slurry component supplier means and the gas pressure supplier provide inputs to the microcontroller as safety signals to prevent initiation of the slurry blending cycle if there is an interruption of these important supplies. The slurry recipe data is provided from the host operations controller and is stored in the microcontroller memory for use in carrying out the slurry blending operation.

Just prior to each wafer process, the electronic controller receives a recipe download from the host operation controller. This recipe contains the sequence of valve actuation times that describe the proportions of the required (or desired) mixture. In addition to the valve actuation times the recipe also includes interation factors that the electronic controller applies to each recipe segment during recipe execution. Each iteration or repetition of the recipe segment valve timing reduces the random error by a statistical averaging process. The more iterations the greater random error reduction.

Figure 5:
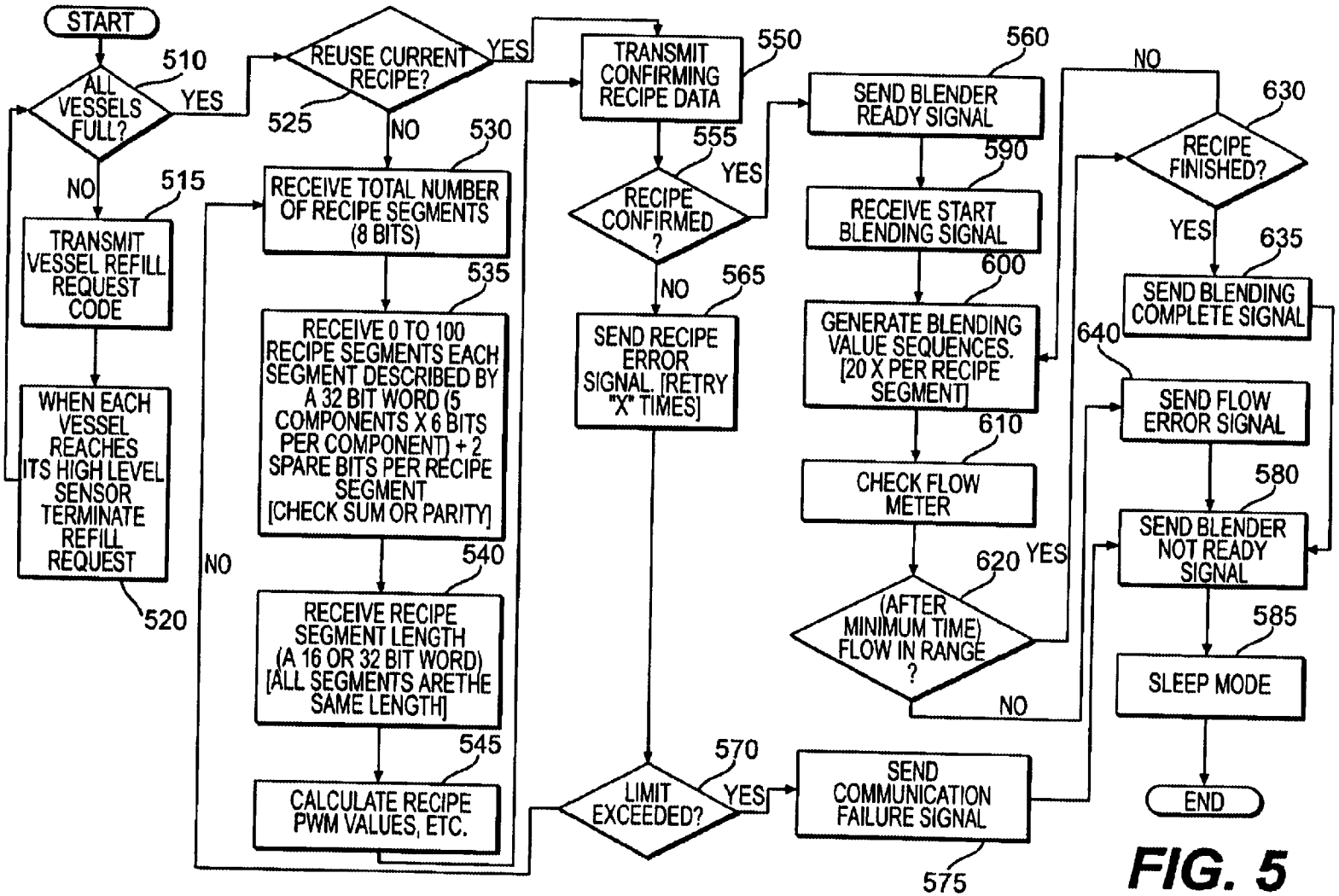
FIG. 5 is a flow chart illustrating the steps in the method of the present invention.

The operation and process for the blending of the slurry components is shown in a flow chart in FIG. 5. When a slurry recipe blend is to start, the microcontroller determines in step 510 whether the reservoirs are full, from the high liquid level sensor. If a reservoir is not full, the microprocessor transmits a vessel refill request code in step 515. When all reservoir vessels are full, the microprocessor terminates the refill request at step 520.

When the reservoir vessels are all determined to be full, the microcontroller receives a signal from the host operation controller indicating whether to reuse the current slurry blend recipe which was used last, see, step 525. If the indication is that a new recipe is to be used, the microcontroller receives the total number of recipe segments in step 530, and can receive and store up to 100 recipe segments at step 535, which recipe segments are for use during the sequential CMP processing steps on a given wafer. The microcontroller receives at step 540 the recipe segment length, and at step 545 calculates the recipe required valve open time pulse width modulation values, and transmits back to the host controller the confirming recipe data at step 550. If the determination at step 525 is to reuse the current recipe, the process advances to step 550 at which there is a transmission confirming the recipe data to the host controller 14 with receipt of recipe confirmation at step 555. A yes signal will send the blend ready signal at step 560. If the recipe is not confirmed, a recipe error signal is generated at step 565, followed by a determination at step 570 of whether the limit is exceeded for the error signal. If the limit on retrying to confirm the recipe is not exceeded the process returns to step 530. If the limit is exceeded, a failure signal is communicated at step 575 to the send blender not ready signal step 580 which puts the blender apparatus in a sleep mode at step 585.

If the recipe is confirmed at step 555, a start blending signal is received at step 590 followed by a generate blending valve sequences step 600, a check flow meter step 610, and a recheck after a minimum time of whether the flow rate is in range at step 620. If the flow rate at step 620 is not in the desired range, a send flow error signal is sent out at step 640. If the flow rate is within range, the blending continues until the recipe is finished at step 630, after which a blending complete signal is sent at step 635, and a send blender not ready signal at step 640, followed by the apparatus being placed in sleep mode at step 585. If the recipe is not finished the process returns to the generate blending valve sequence step 600 and the process proceeds until the recipe is finished.

In the CMP processing workstation a robot positions the semiconductor wafer for polishing, and the reservoirs of the apparatus of the present invention are refilled during the positioning. The new recipe from the host controller is downloaded and confirmed. On receipt of a start signal from the host controller, the point of use apparatus blends the recipe segments as specified in the recipe stored in the microcontroller memory. As each recipe segment is completed, confirmation flow rate data is sent to the host controller. When the recipe is completed, or upon receipt of the other instructions, the point of use apparatus returns to a standby station, and executes a partial system flush/purge and waits for the next wafer. If the apparatus is idle for an extended period, a complete system flush/purge ensures fresh slurry for the next wafer.

This invention has the ability to execute unique recipes for each wafer processed. The resolution of recipe adjustment is sufficiently fine to allow correction for variations in incoming chemicals, changes in target process performance, or other measurable factors. This capability provides several process advantages.

In current bulk chemical dispense systems, chemical concentrations vary from the ideal. These variances result from inaccuracy in the mixing/diluting methods employed during chemical preparation, time since preparation, storage conditions, etc. Measuring the concentration of a pure chemical is generally far simpler than attempting to measure the concentration in a complex mixture (like a CMP Slurry). Many bulk delivery systems include instrumentation (conductivity, density, pH, specific ion, etc.) that report this parameter to a central factory control and monitoring system (FCMS). This information is often readily available in the typical semiconductor fab facility. The electronic controller in the present invention can be programmed, to adjust the ratios of valve actuation times between the up to five liquids such that variations in incoming chemical concentrations can be eliminated from the resultant mixed liquid.

The behavior of the mixed liquid at the point of use is likely to vary over time, as other process conditions change. The invention can be programmed to adjust the ratios of valve actuation times between the up to five liquids such that process variations from wafer to wafer ore batch to batch can be minimized.

The flow of parts through a process step may produce variations in the required process behavior from part to part. These variations could be due to differences in the structure of the parts, variations in previous process steps, or variations in the intended use of the parts. The invention can be programmed to adjust the ratios of valve actuation times between the up to five liquids such that the effect of the process step on the part is customized to the specific requirements of that part. Such adjustment can be used to allow parts to flow through the process step in any desired order, eliminating batching of parts and manual setup of machinery between batches. This adjustment can also be used to compensate for measurable variances in the parts, due to previous process steps.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. Apparatus for providing a predetermined consistent liquid mixture to a point of use, comprising:

a plurality of liquid component reservoirs, each of said reservoirs including an inlet port for loading a liquid component of the liquid mixture into the respective reservoir and an outlet port;

a gas supplier configured to provide the same gas pressure within each reservoir;

a plurality of valves, each valve being individually coupled to a respective one of the reservoir outlet ports;

a mixing assembly disposed proximate the point of use, the mixing assembly being selectively, fluidly communicable with each of the reservoirs; and an electronic controller in communication with the plurality of valves and constructed for repetitively sequencing actuation of the plurality of valves to discharge upon each valve actuation predetermined doses of a selected plurality of liquid components from the plurality of reservoirs to the mixing assembly such that the selected liquid components are mixed in the mixing assembly proximate a time of use of the liquid mixture, wherein the selected liquid components are mixed in the mixing assembly during the time of use of the liquid mixture.

2. The apparatus set forth in claim 1, wherein the mixing assembly includes a discharge port.

3. The apparatus set forth in claim 2, wherein the mixing assembly includes an inlet port for admitting a fluid for at least one of purging, cleaning and flushing the mixing assembly.

4. The apparatus set forth in claim 2, wherein said mixing assembly comprises a generally circular, planar, smear mixing substrate having a central discharge aperture through said substrate.

5. The apparatus set forth in claim 4, wherein the reservoir outlet ports are arranged in an annular array feeding into the mixing assembly near the periphery of the smear mixing substrate.

6. The apparatus set forth in claim 1, wherein the electronic controller controls filling of the reservoirs with the selected liquid components.

7. The apparatus set forth in claim 1, wherein a predetermined liquid dose comprises a fraction of the total volume of the reservoir containing the liquid component.

8. The apparatus set forth in claim 1, wherein said valves are normally closed valves and the electronic controller sequences the valve actuation such that the valves operate with a constant open time and the number of actuations for respective component reservoir valves is varied to control the relative doses from respective component reservoirs for providing a predetermined ratio of liquid components in the resultant liquid mixture.

9. The apparatus set forth in claim 1, wherein said valves are normally closed valves and the electronic controller sequences the valve actuation such that the respective valves have predetermined different open times to control the respective doses from respective component reservoirs for providing a predetermined ratio of liquid components in the resultant liquid mixture.

10. The apparatus set forth in claim 1, wherein said electronic controller controls the predetermined component doses by sequencing the respective valve activations with the same period of actuation while varying the number of actuation cycles for respective component reservoir valves.

11. The apparatus set forth in claim 1, wherein said electronic controller controls the predetermined component doses by sequencing the respective valve actuations with a variable period of actuation selected for respective valves.

12. The apparatus set forth in claim 1, wherein at least one of said liquid components comprises a plurality of liquid sub-components.

13. The apparatus set forth in claim 1, wherein the controller is configured to dynamically control actuation of the plurality of valves during the time of use of the liquid mixture.

14. The apparatus set forth in claim 13, wherein the controller is configured to dynamically adjust the liquid mixture.

15. Apparatus for providing a predetermined consistent liquid mixture to a point of use, comprising:

a plurality of liquid component reservoirs, each of said reservoirs including an inlet port for loading a liquid component of the liquid mixture into the respective reservoir and an outlet port;

a gas supplier configured to provide the same gas pressure within each reservoir;

a plurality of valves, each valve being individually coupled to a respective one of the reservoir outlet ports;

a mixing assembly disposed proximate the point of use, the mixing assembly being selectively, fluidly communicable with each of the reservoirs; and an electronic controller in communication with the plurality of valves and constructed for repetitively sequencing actuation of the plurality of valves to discharge upon each valve actuation predetermined doses of a selected plurality of liquid components from the plurality of reservoirs to the mixing assembly such that the selected liquid components are mixed in the mixing assembly proximate a time of use of the liquid mixture, wherein the mixing assembly includes a discharge port and flow measurement means.

16. The apparatus set forth in claim 15, wherein the liquid flow measurement sensor senses the volume of liquid flowing from the mixing assembly discharge port.

17. The apparatus set forth in claim 16, wherein the controller is configured to dynamically control actuation of the plurality of valves at least partly based on feedback information.

18. The apparatus set forth in claim 17, wherein the feedback information comprises information from the liquid flow measurement sensor.

19. The apparatus set forth in claim 16, wherein the controller is configured to dynamically control actuation of the plurality of valves at least partly based on feedforward information.

20. The apparatus set forth in claim 19, wherein the feedforward information comprises chemical information.

21. The apparatus set forth in claim 15, wherein the selected liquid components are mixed in the mixing assembly during the time of use of the liquid mixture.

22. Apparatus for providing a predetermined consistent liquid mixture to a point of use, comprising:

a plurality of liquid component reservoirs, each of said reservoirs including an inlet port for loading a liquid component of the liquid mixture into the respective reservoir and an outlet port;

a gas supplier configured to provide the same gas pressure within each reservoir;

a plurality of valves, each valve being individually coupled to a respective one of the reservoir outlet ports;

a mixing assembly disposed proximate the point of use, the mixing assembly being selectively, fluidly communicable with each of the reservoirs; and an electronic controller in communication with the plurality of valves and constructed for repetitively sequencing actuation of the plurality of valves to discharge upon each valve actuation predetermined doses of a selected plurality of liquid components from the plurality of reservoirs to the mixing assembly such that the selected liquid components are mixed in the mixing assembly proximate a time of use of the liquid mixture, wherein the liquid mixture is a slurry mixture.

23. Apparatus for providing a predetermined consistent liquid mixture to a point of use, comprising:

a plurality of liquid component reservoirs, each of said reservoirs including an inlet port for loading a liquid component of the liquid mixture into the respective reservoir and an outlet port;

a gas supplier configured to provide the same gas pressure within each reservoir;

a plurality of valves, each valve being individually coupled to a respective one of the reservoir outlet ports;

a mixing assembly disposed proximate the point of use, the mixing assembly being selectively, fluidly communicable with each of the reservoirs; and an electronic controller in communication with the plurality of valves and constructed for repetitively sequencing actuation of the plurality of valves to discharge upon each valve actuation predetermined doses of a selected plurality of liquid components from the plurality of reservoirs to the mixing assembly such that the selected liquid components are mixed in the mixing assembly proximate a time of use of the liquid mixture, wherein the plurality of reservoirs are each cylindrical members disposed in an annular array about a central longitudinal axis which is aligned with the longitudinal axes of the plurality of cylindrical reservoir members.

24. Apparatus for providing a precisely mixed liquid mixture according to a predetermined recipe, comprising:

a reservoir section comprising a plurality of liquid component reservoirs having a gas inlet port, a liquid component outlet port, and a liquid component inlet port;

a gas manifold section disposed at one end of the reservoirs and connecting the individual reservoirs to a source of gas pressure;

a valving section disposed at an opposed end of the reservoirs, with a plurality of valves coupled individually to the respective reservoir liquid component outlet ports, and including valve outlets through which liquid component doses are discharged;

a mixing section proximate a point of use of the liquid mixture, the mixing section being coupled to the valving section with the discharged liquid component doses being directed to said mixing section;

an electronic controller section for controlling the operation of the valving section, with the individual valves being actuated in a repetitive sequence for predetermined actuation periods to control the volume of liquid component which is discharged from the respective reservoirs as repetitive doses until the predetermined liquid mixture recipe is completed, the controller being configured to dynamically control actuation of the plurality of valves proximate a time of use of the liquid mixture; and a mixing assembly into which the predetermined doses of liquid component are discharged for mixing said liquid components to form the predetermined liquid mixture, said mixing assembly including a discharge port.

25. The apparatus set forth in claim 24, wherein the liquid mixture is a slurry mixture.

26. The apparatus set forth in claim 24, wherein the plurality of reservoirs are each cylindrical members disposed in an annular array about a central longitudinal axis which is aligned with the longitudinal axes of the plurality of cylindrical reservoir members.

27. The apparatus set forth in claim 24, wherein the electronic controller controls filling of the reservoirs with selected liquid components.

28. The apparatus set forth in claim 24, wherein a predetermined liquid dose comprises a fraction of the total volume of the reservoir containing the liquid component.

29. The apparatus set forth in claim 24, wherein said valves are normally closed valves and the electronic controller sequences the valve actuation such that the valves operate with a constant open time and the number of actuations for respective component reservoir valves is varied to control the relative doses from respective component reservoirs for providing a predetermined ratio of liquid components in the resultant liquid mixture.

30. The apparatus set forth in claim 24, wherein said valves are normally closed valves and the electronic controller sequences the valve actuation such that the respective valves have predetermined different open times to control the respective doses from respective component reservoirs for providing a predetermined ratio of liquid components in the resultant liquid mixture.

31. The apparatus set forth in claim 24, wherein said electronic controller controls the predetermined component doses by sequencing the respective valve activations with the same period of actuation while varying the number of actuation cycles for respective component reservoir valves.

32. The apparatus set forth in claim 24, wherein at least one of said liquid components comprises a plurality of liquid sub-components.

33. The apparatus set forth in claim 24, wherein the controller is configured to dynamically control actuation of the plurality of valves during the time of use of the liquid mixture.

34. The apparatus set forth in claim 33, wherein the controller is configured to dynamically adjust the liquid mixture.

35. A system for producing a liquid mixture according to a predetermined recipe for use at a point of use, comprising:

a central operations controller for determining the predetermined liquid mixture recipe for use at the point of use; and an apparatus capable of being located at the point of use for precisely mixing a predetermined liquid mixture recipe proximate the point of use, said apparatus comprising a plurality of liquid component reservoirs, each of said reservoirs including an inlet port for loading a liquid component of the liquid mixture into the respective reservoir and an outlet port, a gas supplier configured to maintain the same gas pressure within each reservoir, a plurality of valves, each valve being individually coupled to a respective one of the reservoir outlet ports, an electronic controller communicating with the central operations controller, said electronic controller controlling repetitively sequenced actuation of the plurality of valves to discharge upon each valve actuation a precise dose of a selected plurality of liquid components from the plurality of reservoirs to provide the predetermined liquid mixture according to the recipe, the selected liquid components being mixed proximate a time of use of the liquid mixture, and a liquid component supplier including sources of the liquid components and including valves for loading the liquid components into the plurality of liquid component reservoirs.

36. The system set forth in claim 35, further including a chemical mechanical polisher apparatus at the point of use and controlled by the central operations controller which coordinates operation of the chemical mechanical polisher apparatus with the liquid mixture apparatus.

37. The system set forth in claim 35, wherein the selected liquid components are mixed in the mixing assembly during the time of use of the liquid mixture.

38. The system set forth in claim 35, wherein at least one of said liquid components comprises a plurality of liquid sub-components.

39. The system set forth in claim 35, wherein the electronic controller is configured to dynamically control actuation of the plurality of valves during the time of use of the liquid mixture.

40. The system set forth in claim 39, wherein the electronic controller is configured to dynamically adjust the recipe.

41. Apparatus for providing a precisely mixed liquid mixture according to a predetermined recipe, comprising:

a reservoir section comprising a plurality of liquid component reservoirs having a gas inlet port, a liquid component outlet port, and a liquid component inlet port;

a gas manifold section disposed at one end of the reservoirs and connecting the individual reservoirs to a source of gas pressure;

a valving section disposed at an opposed end of the reservoirs, with a plurality of valves coupled individually to the respective reservoir liquid component outlet ports, and including valve outlets through which liquid component doses are discharged;

a mixing section proximate a point of use of the liquid mixture, the mixing section being coupled to the valving section with the discharged liquid component doses being directed to said mixing section; and an electronic controller section for controlling the operation of the valving section, with the individual valves being actuated in a repetitive sequence for predetermined actuation periods to control the volume of liquid component which is discharged from the respective reservoirs as repetitive doses until the predetermined liquid mixture recipe is completed, the controller being configured to dynamically control actuation of the plurality of valves proximate a time of use of the liquid mixture, wherein the selected liquid components are mixed in the mixing assembly during the time of use of the liquid mixture.

42. The apparatus set forth in claim 41, further including a mixing assembly into which the predetermined doses of liquid component are discharged for mixing said liquid components to form the predetermined liquid mixture, said mixing assembly including a discharge port.

43. The apparatus set forth in claim 42, wherein the mixing assembly includes a liquid flow measurement means.

44. The apparatus set forth in claim 43, wherein the liquid flow measurement sensor senses the volume of liquid flowing from the mixing assembly discharge port.

45. The apparatus set forth in claim 43, wherein the controller is configured to dynamically control actuation of the plurality of valves at least partly based if on feedback information.

46. The apparatus set forth in claim 45, wherein the feedback information comprises information from the liquid flow measurement means.

47. The apparatus set forth in claim 43, wherein the controller is configured to dynamically control actuation of the plurality of valves at least partly based on feedforward information.

48. The apparatus set forth in claim 47, wherein the feedforward information comprises chemical information.

49. The apparatus set forth in claim 42, wherein the mixing assembly includes an inlet port for admitting a fluid for at least one of purging, cleaning and flushing the mixing assembly.

50. The apparatus set forth in claim 42, wherein said mixing assembly comprises a generally circular, planar, smear mixing substrate having a central discharge aperture through said substrate.

51. The apparatus set forth in claim 42, wherein the reservoir outlet ports are arranged in an annular array feeding into the mixing assembly near the periphery of the smear mixing substrate.

* * * * *

UNITED STATES PATENT AND TRADEMARK OFFICE

CERTIFICATE OF CORRECTION

PATENT NO. : 6,616,014 B1
DATED : September 9, 2003
INVENTOR(S) : Peter Martin Pozniak et al.

It is certified that error appears in the above-identified patent and that said Letters Patent is hereby corrected as shown below:

Title page,
Item [75], Inventors, substitute the following:

-- [75] Inventors: Peter Martin Pozniak, San Jose, CA (US); Charles Andre Prevost, Salinas, CA (US); Rakesh Kumar Singh, Allahabad, (IN); Sau Van Vo, San Jose, CA (US); Benjamin Rush Roberts, Los Altos, CA (US) --

Signed and Sealed this

Twenty-fourth Day of August, 2004

JON W. DUDAS
*Director of the United States Patent and Trademark Office*